United States Patent [19]

Dean et al.

[11] 4,437,092

[45] Mar. 13, 1984

[54] COLOR VIDEO DISPLAY SYSTEM HAVING PROGRAMMABLE BORDER COLOR

[75] Inventors: Mark E. Dean, Boynton Beach, Fla.; Lewis C. Eggebrecht, Rochester, Minn.; David A. Kummer, Boca Raton; Jesus A. Saenz, Coral Springs, both of Fla.

[73] Assignee: International Business Machines Corporation, Armonk, N.Y.

[21] Appl. No.: 292,069

[22] Filed: Aug. 12, 1981

[51] Int. Cl.[3] ..... G09G 1/28

[52] U.S. Cl. ..... 340/703; 340/730; 340/734

[58] Field of Search ..... 340/730, 734, 703, 723, 340/724, 720; 273/DIG. 28

[56] References Cited

U.S. PATENT DOCUMENTS 4,093,221 6/1978 Dash ..... 340/734
4,149,184 4/1979 Giddings et al. ..... 340/730
4,155,095 5/1979 Kirschner ..... 340/703

FOREIGN PATENT DOCUMENTS 2617 6/1979 European Pat. Off. .... 273/DIG. 28

*Primary Examiner*—Marshall M. Curtis
*Attorney, Agent, or Firm*—Sughrue, Mion, Zinn, Macpeak & Seas

[57] ABSTRACT

A central processing unit (10) loads a border register (36) with four color bits representing digital color signals to be used in determining the color of only the border area (40) surrounding the video area (42) of a cathode ray tube display screen (44). A BORDER CONTROL TIME signal is generated at the appropriate times in the horizontal and vertical scanning periods of the cathode ray tube to apply the digital color border signals (R, G, G, I) to a composite video signal generator (38) which generates the composite video signal for a TV set (14) or a TV monitor.

3 Claims, 4 Drawing Figures

COLOR VIDEO DISPLAY SYSTEM HAVING PROGRAMMABLE BORDER COLOR

TECHNICAL FIELD

The invention relates generally to color television systems and, more particularly, to a circuit for independently controlling the color of only the border around the video area of the screen of a TV receiver or monitor employing a cathode ray tube (CRT) display device.

BACKGROUND OF THE INVENTION

In cathode ray tube display devices used to display alpha-numeric and graphic images in a data processing system, such as a small personal computer or computer-controlled TV game, it is often desirable to control the color of the border area surrounding the video or image area in order to make the total display more aesthetically pleasing or easier to view. The color of this border should be controlled independently of the color and data displayed in the video area of the CRT screen.

Controlling the color of the border around the video area of the display screen is different from controlling the color of the edge of an individual character (e.g. U.S. Pat. No. 3,984,828) or the color of the background of a displayed word (e.g. U.S. Pat. No. 3,911,418).

SUMMARY OF THE INVENTION

In a data processing system, such as a small personal computer, a 4-bit software-loadable border register is provided which will independently determine the color of only the border area around the video raster zone of the CRT in a conventional television receiver or monitor. A border color control signal is enabled through the same multiplexer or color video control unit that provides the video (data and color) information supplied to the video area of the CRT screen, but this control signal is enabled at pre-defined time intervals during the scanning of the screen such that the color of the border, only, is completely independent of the video information displayed on the screen. Up to sixteen colors are available for the border.

For a better understanding of the present invention, together with other and further advantages and features thereof, reference is made to the following description taken in connection with the accompanying drawings, the scope of the invention being pointed out in the appended claims.

DETAILED DESCRIPTION OF THE PREFERRED EMBODIMENT

Figure 1:
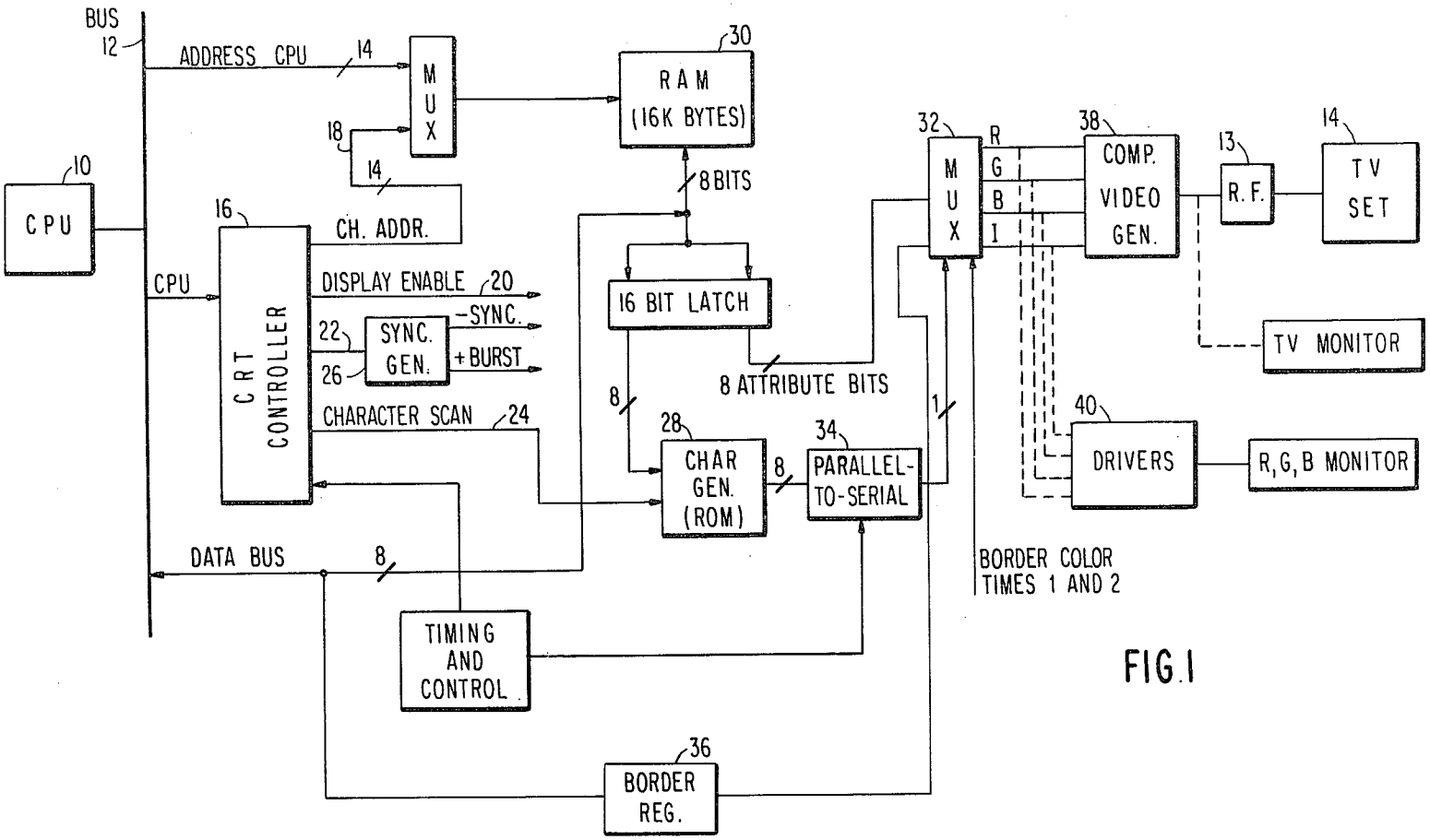
FIG. 1 is a block diagram of a portion of a data processing system, such as a personal computer, which generates a composite video color signal usable by a conventional NSTC television receiver or a monitor for displaying in the video area of the screen thereof alphanumeric and graphic information in colors determined by digital color signals generated within the system, and which includes the novel border register of this invention.

FIG. 1 is a block diagram of a portion of a data processing system, such as a personal computer, in which alpha/numeric and graphic data, generated by a keyboard or other components of the system, are displayed on a cathode ray tube, such as a conventional television receiver or monitor.

Figure 3:
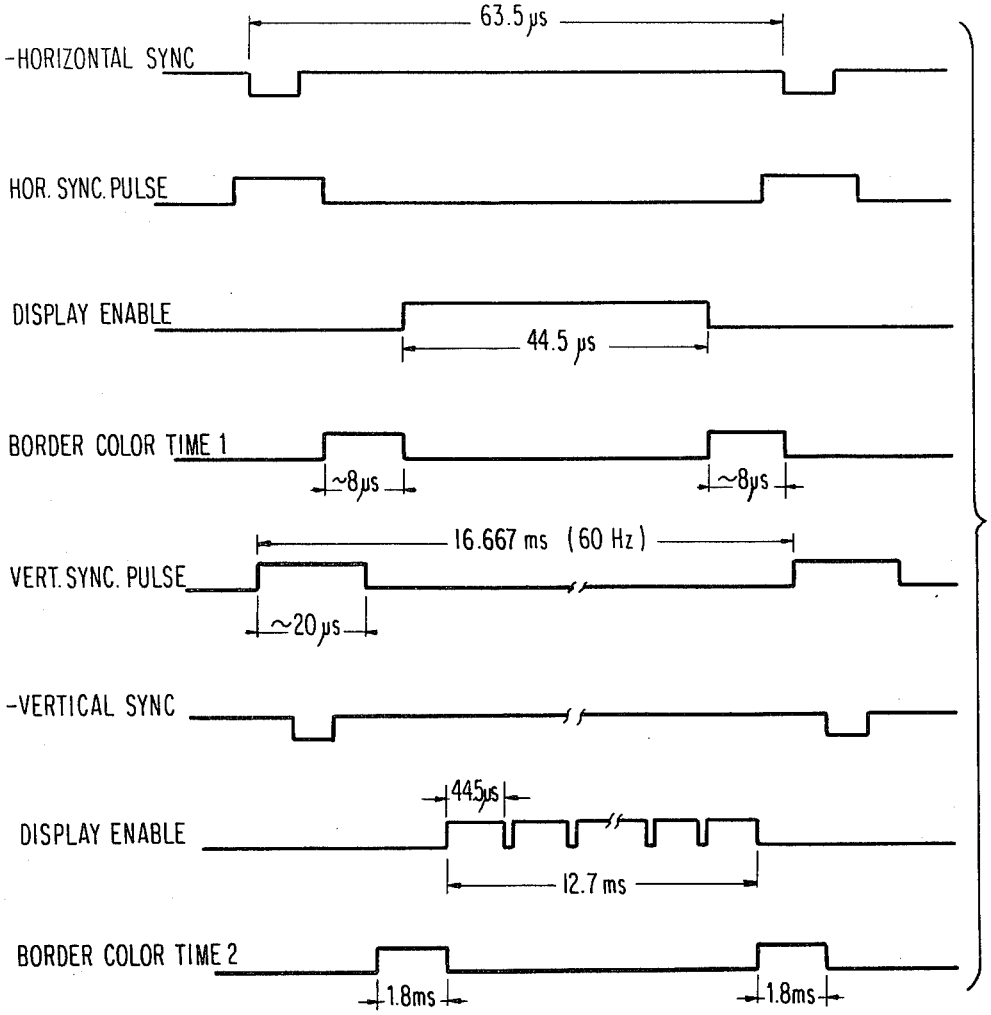
FIG. 3 is a timing diagram illustrating the pre-defined times at which the border color control signal is enabled in order to control the color of the complete border surrounding the field area of a TV screen.

Such a system is one example of a source for the various signals applied to the novel composite video generator 38 whose details are illustrated in FIG. 3.

A central processing unit (CPU) 10 is connected to a three-state system bus 12 including an 8-bit data bus. Let us assume that a character, such as one entered by a keyboard coupled to the bus, is to be displayed on the cathode ray tube (CRT) of a conventional TV receiver 14. A conventional CRT controller 16, such as a Motorola 6845 chip, controlled by CPU 10 via the bus 12, generates the CHARACTER ADDRESS on output lines 18, CHARACTER SCAN on lines 24, and the television frequency components on lines 20 and 22. There are produced on output lines 22 the horizontal and vertical synchronizing pulses which are applied to a logic circuit (FIG. 2) and to a sync generator 26 which produces −SYNC and +BURST signals. A DISPLAY ENABLE signal is produced on line 20, and the scanning pulses are produced on line 24 and applied to a character generator (ROM) 28. An 8-bit character code is fetched from a random access memory (RAM) 30 at the specified character address. An 8-bit attribute code is also fetched, and four of these bits designate the color of the character to be displayed, i.e. the foreground color of the character, while the other four bits designate the background color of the character. The four character color bits are applied to a multiplexer (MUX) 32, such as a 74LS153 chip, which outputs the red (R), green (G), blue (B) and intensity (I) signals from which there is derived the composite video color signal to be applied to the TV receiver.

Multiplexer 32 is under the control of the serial character dots from the 8-to-1 parallel-to-serial converter 34 connected to the output of the character generator 28 and to the output of a border register 36 which independently determines the color of the border around the TV raster zone in which the alpha/numeric and graphic data are displayed. The digital R, G, B and I signals on the output of multiplexer 32 are applied as inputs to a composite video generator 38 which produces the composite video color signal which can be used directly by a conventional composite monitor or, after being modulated by an R.F. modulator 13, by TV receiver 14, or as inputs to the drivers 40 of a conventional direct drive TV monitor which operates directly from the R, G, B and I signals without the RF modulation required by the TV receiver 14, but which requires externally supplied synchronizing and blanking signals.

Figure 2:
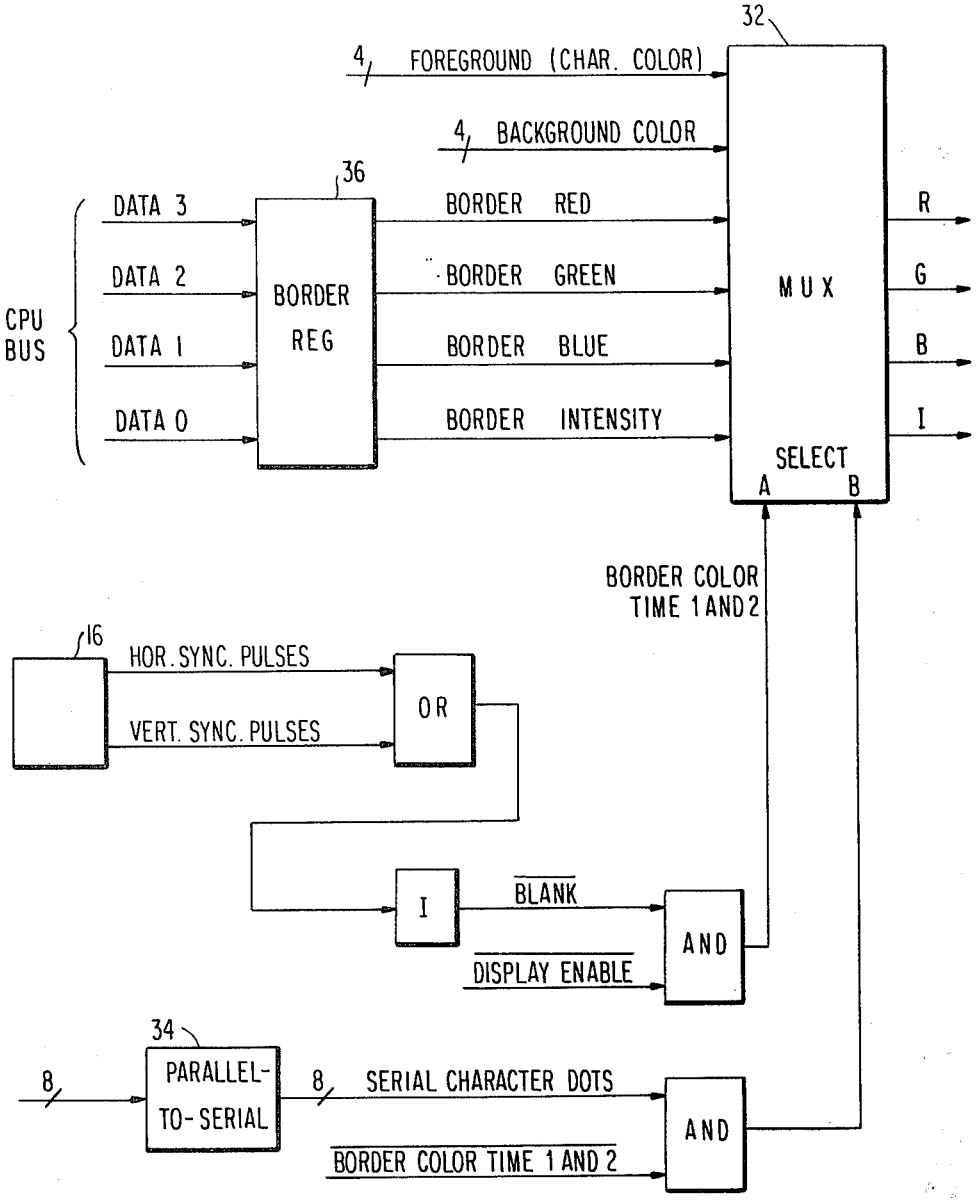
FIG. 2 illustrates the manner in which the border register contents are applied to the video information multiplexer for controlling the color of the border area around the video area of the CRT of the television receiver or a monitor.

The CPU sends via the data bus a four bit data byte specifying the red, green, blue and intensity digital color signals for a particular one of the sixteen colors available for the border. The intensity signal represents a D.C. level which is applied to the composite video signal generator to provide the "brighter" versions of the eight basic colors as described in detail in a copending application Ser. No. 292,074, filed Aug. 12, 1981. As shown in FIG. 2, the contents of the border register 36 are gated to the 74LS153 multiplexer chip at BORDER COLOR TIME via the CRT CONTROLLER 16 at predetermined time intervals during the horizontal and vertical scannings of the screen, which intervals are illustrated in the timing diagram of FIG. 3. As shown there, at each BORDER COLOR TIME 1 the border areas 1 of the screen are "painted" the designated color, and at each BORDER COLOR TIME 2 the border areas 2 are painted.

Figure 4:
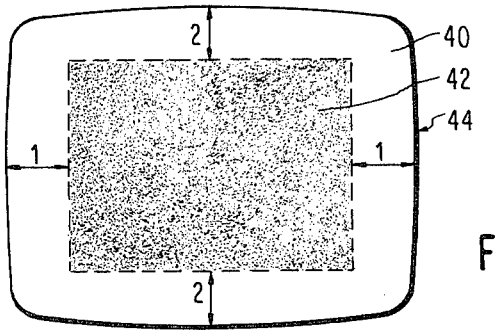
FIG. 4 is a schematic diagram of a TV screen showing the "video" and "border" areas.

FIG. 4 is a pictorial representation of a TV screen 44 illustrating the video area 42 and border area 40 and the portions of the border area which are painted at times 1 and 2.

While there has been described what is at present considered to be the preferred embodiment of this invention, it will be obvious to those skilled in the art that various changes and modifications may be made therein without departing from the invention, and it is, therefore, intended to cover all such changes and modifications as fall within the true spirit and scope of the invention.

We claim:

1. A color video display system comprising:

a color cathode-ray tube display;

central processing means for providing a signal defining a normal display area and first data representing video information to be displayed on said cathode-ray tube display in said normal display area of said cathode-ray tube display and second data representing a color of a predefined border area completely surrounding said normal display area and extending to all display edges of said cathode-ray tube display;

means operating in response to vertical and horizontal synchronizing signals of said display and said display area defining signal for generating a control signal having a first state when a scanning beam of said cathode-ray tube display is scanning said normal display area and a second state when said scanning beam is scanning said border area; and multiplexer means operating in response to said control signal for applying said first data to said color cathode-ray tube display when said control signal is in said first state and said second data to said cathode-ray tube display when said control signal is in said second state;

whereby a selected color may be provided in said border area and memory limited to that necessary for storing information to be displayed in said normal display area.

2. The display system of claim 1, further comprising a border color register disposed between said central processing means and said multiplexer means for storing said second data.

3. The display system of claim 2, wherein said control signal generating means comprises gating means operating in response to vertical and horizontal synchronizing signals of said cathode-ray tube display.

* * * * *